US011441204B2

(12) United States Patent
Park

(10) Patent No.: US 11,441,204 B2
(45) Date of Patent: Sep. 13, 2022

(54) METHOD OF MANUFACTURING CAM PIECE FOR CONTINUOUSLY VARIABLE VALVE DURATION AND CAM PIECE MANUFACTURED THEREFROM

(71) Applicants: Hyundai Motor Company, Seoul (KR); Kia Motors Corporation, Seoul (KR)

(72) Inventor: Sung-Hwan Park, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 164 days.

(21) Appl. No.: 16/600,197

(22) Filed: Oct. 11, 2019

(65) Prior Publication Data

US 2020/0181726 A1 Jun. 11, 2020

(30) Foreign Application Priority Data

Dec. 11, 2018 (KR) ..... 10-2018-0159478

(51) Int. Cl.

| | |
|---|---|
| ***C21D 9/30*** | (2006.01) |
| ***C21D 5/00*** | (2006.01) |
| ***C22C 37/10*** | (2006.01) |
| ***C22C 37/04*** | (2006.01) |
| ***C22C 37/08*** | (2006.01) |
| ***C21D 1/46*** | (2006.01) |
| ***C22C 33/08*** | (2006.01) |
| ***F01L 1/08*** | (2006.01) |

(52) U.S. Cl.

CPC ..... *C21D 9/30* (2013.01); *C21D 1/46* (2013.01); *C21D 5/00* (2013.01); *C22C 33/08* (2013.01); *C22C 37/04* (2013.01); *C22C 37/08* (2013.01); *C22C 37/10* (2013.01); *F01L 1/08* (2013.01); *C21D 2211/002* (2013.01); *F01L 2301/00* (2020.05); *F01L 2303/00* (2020.05)

(58) Field of Classification Search

None

See application file for complete search history.

(56) References Cited

U.S. PATENT DOCUMENTS 3,860,457 A * 1/1975 Vourinen ..... C22C 37/04 148/614
5,028,281 A * 7/1991 Hayes ..... C21D 5/00 148/321

(Continued)

FOREIGN PATENT DOCUMENTS

CN 106947912 A * 7/2017
JP 2014181356 A * 9/2014
WO WO-2006022494 A1 * 3/2006 ..... C21D 1/32

*Primary Examiner* — Sally A Merkling
*Assistant Examiner* — Dean Mazzola
(74) *Attorney, Agent, or Firm* — Morgan, Lewis & Bockius LLP

(57) ABSTRACT

A method of manufacturing a cam piece for a continuously variable valve duration and a cam piece manufactured therefrom, and more particularly, to material and heat treatment conditions of a cam piece, may include manufacturing a cam piece by casting; heating the cam piece; maintaining a heating temperature; and salt-bathing the cam piece, in which the cam piece includes 3.2 to 4.2 wt % of carbon (C), 2.2 to 3.4 wt % of silicon (Si), and the balance iron (Fe), and may have a carbon equivalent value of 4.4 to 4.6.

2 Claims, 1 Drawing Sheet

(56) References Cited

U.S. PATENT DOCUMENTS

| | | | | |
|---|---|---|---|---|
| 5,837,069 | A * | 11/1998 | Deards | C21D 5/00 148/323 |
| 2009/0320971 | A1 * | 12/2009 | Bronzato | C21D 1/20 148/612 |
| 2013/0105047 | A1 * | 5/2013 | Zanardi | C22C 37/04 148/545 |

* cited by examiner

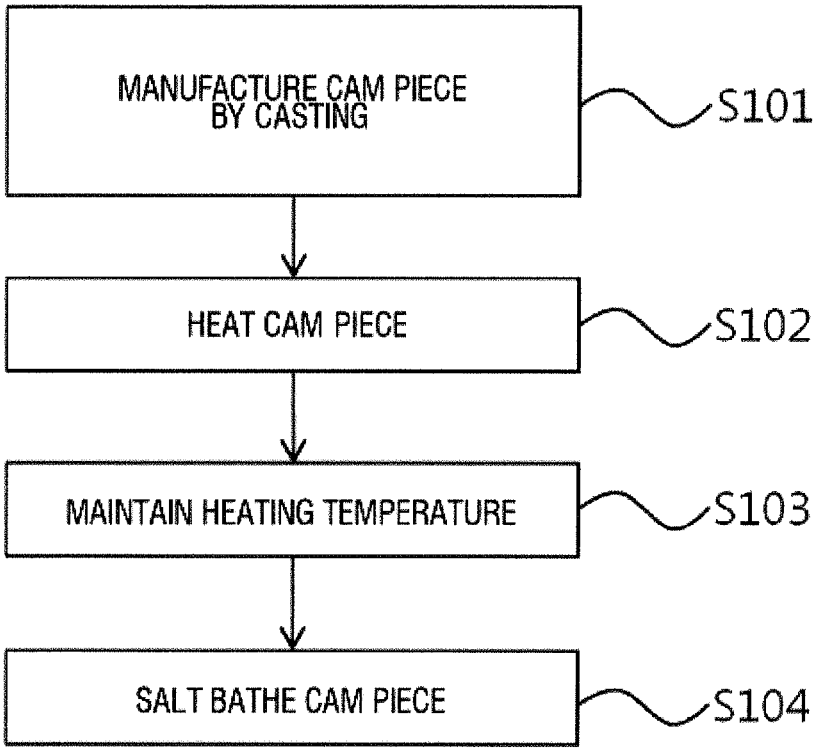
MANUFACTURE CAM PIECE BY CASTING
S101
HEAT CAM PIECE
S102
MAINTAIN HEATING TEMPERATURE
S103
SALT BATHE CAM PIECE
S104

METHOD OF MANUFACTURING CAM PIECE FOR CONTINUOUSLY VARIABLE VALVE DURATION AND CAM PIECE MANUFACTURED THEREFROM

CROSS-REFERENCE TO RELATED APPLICATIONS

The present application claims priority to Korean Patent Application No. 10-2018-0159478, filed on Dec. 11, 2018, the entire contents of which is incorporated herein for all purposes by this reference.

BACKGROUND OF THE INVENTION

Field of the Invention

The present invention relates to a method of manufacturing a cam piece for a continuously variable valve duration and a cam piece manufactured therefrom, and more particularly, to material and heat treatment conditions of a cam piece.

Description of Related Art

A continuously variable valve duration (CVVD) is a device that adjusts the opening time of intake valves and exhaust valves of an internal combustion engine, and a cam piece, which is one constituent element thereof, adjusts a lift amount and an opening/closing time of each valve.

Since the cam piece includes a cam lobe provided on both ends thereof, a shaft, and projections integrally formed with the shaft and the center thereof is formed with a hollow part, shapes of parts are complicated and high resistance and pressure are imposed on a portion which is brought into contact with another device element, so that high tensile strength and surface hardness are required.

By use of existing materials and process methods, complex shapes of parts cannot be implemented and desired physical properties cannot be satisfied. In the case of a method of sintering a powder and pressing the powder and a method of hot forging a round bar, desired physical properties may be satisfied, but it is difficult to implement an integral-type shape, and a grey cast iron hardening method using a chiller and hardening of spheroidal graphite cast iron using high frequency waves can implement integral shapes, but cannot satisfy required physical properties.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to simultaneously implementing a complex shape of a hollow cam piece and satisfy physical properties required therefor.

To achieve the object, the present invention is a method of manufacturing a cam piece for a continuously variable value duration, including: manufacturing a cam piece by casting; heating the cam piece; maintaining a heating temperature; and salt-bathing the cam piece, in which the cam piece may include 3.2 to 4.2 wt % of carbon (C), 2.2 to 3.4 wt % of silicon (Si), and the balance iron (Fe), and may have a carbon equivalent value of 4.4 to 4.6.

Preferably, a total content of nickel (Ni), copper (Cu), and molybdenum (Mo) of the cam piece may be 1.9 to 2.1 wt %.

Preferably, a content of nickel (Ni) may be 1.0 wt % or less.

Preferably, a content of copper (Cu) may be 0.5 to 1.0 wt %.

Preferably, a content of molybdenum (Mo) may be 0.5 to 1.0 wt %.

Preferably, the cam piece may further include 0.3 wt % or less of chromium (Cr).

Preferably, a heating temperature may be 890 to 930° C. and a heating holding time may be 70 to 110 minutes.

Preferably, a salt bath temperature may be 270 to 290° C. and a salt bath holding time may be 50 to 70 minutes.

The present invention may simultaneously implement a complex shape of a hollow cam piece and satisfy physical properties required therefor.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 1 is a flowchart of a method of manufacturing a cam piece for a continuously variable valve duration.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the FIGURES, reference numbers refer to the same or equivalent portions of the present invention throughout the several FIGURES of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

FIG. 1 is a flowchart of a method of manufacturing a cam piece for a continuously variable valve duration. Referring to FIG. 1, the present invention may include: manufacturing a cam piece by casting (S101); heating the cam piece (S102); maintaining a heating temperature (S103); and salt-bathing the cam piece (S104). The present invention includes manufacturing a cam piece for a continuously variable valve duration by casting, and then subjecting the cam piece to austempering heat treatment, unlike the cam piece manufactured by sintering and pressing in the related art.

The cam piece includes 3.2 to 4.2 wt % of carbon (C), 2.2 to 3.4 wt % of silicon (Si), and the balance iron (Fe), and may have a carbon equivalent value of 4.4 to 4.6. The content of carbon (C) is limited to 3.2 to 4.2 wt % which is a content of carbon at a level of FCD500 (universal material) for casting fluidity and smooth gas exhaust, and when silicon (Si) is added in an amount of more than 3.4 wt % as a main element for determining a carbon equivalent, an amount of graphite crystallized is increased, so that the content of silicon (Si) is limited to 2.2 to 3.4 wt % because graphite may be excessively grown. When the carbon equivalent value is less than 4.4, the shrinkage defects occur during casting, and when the carbon equivalent value is more than 4.6, a drop in strength is caused by reduction in spheroidal ratio and coarsening of graphite sizes, so that the carbon equivalent value is limited to 4.4 to 4.6.

The cam piece may further include nickel (Ni), copper (Cu), and molybdenum (Mo), and a total content of nickel (Ni), copper (Cu), and molybdenum (Mo) may be 1.9 to 2.1 wt %. When the total content is less than 1.9 wt %, ferrite and pearlite remain because the cam piece is not sufficiently hardened to the core during the austempering heat treatment, and when the total content is more than 2.1 wt %, brittleness is increased because the hardening capability is excessive during the austemperating heat treatment, so that the total content is limited to 1.9 to 2.1 wt %.

Nickel (Ni) is distributed in the structure to increase toughness by stabilizing austenite, which is a matrix structure. However, when the content of nickel (Ni) is more than 1.0 wt %, an effect of improving toughness rarely occurs and a drop in heat conductivity is caused, so that the content of nickel is limited to 1.0 wt % or less.

Copper (Cu) is distributed in the structure to increase strength by stabilizing pearlite which is a matrix structure. However, when the content of copper (Cu) is more than 1.0 wt %, strength is increased, but brittleness is increased, so that the content of copper (Cu) is limited to 0.5 to 1.0 wt %.

Molybdenum (Mo) is distributed in the structure to increase strength by stabilizing pearlite which is a matrix structure. However, when the content of molybdenum (Mo) is more than 1.0 wt %, strength is increased, but brittleness is increased, so that the content of molybdenum (Mo) is limited to 0.5 to 1.0 wt %.

The cam piece may further include 0.3 wt % or less of chromium (Cr). Chromium (Cr) is distributed in the structure to increase strength by stabilizing pearlite which is a matrix structure. However, when the content of chromium (Cr) is more than 0.3 wt %, strength is increased, but the formation of graphite is hampered and a decrease in graphite fraction which is a heat conduction factor causes a drop in heat conductivity. Furthermore, since brittleness is increased due to production of chromium carbide, the content of chromium (Cr) is limited to 0.3 wt % or less.

The cam piece may further include 0.2 to 0.8 wt % of manganese (Mn). Manganese (Mn) is distributed in the structure to increase strength by stabilizing pearlite which is a matrix structure. However, when the content of manganese (Mn) is more than 0.8 wt %, strength is increased, but the formation of graphite is hampered and a decrease in graphite fraction which is a heat conduction factor causes a drop in heat conductivity. Since a drop in heat conductivity adversely affects durability, the content of manganese (Mn) is limited to 0.2 to 0.8 wt %.

The heating temperature may be 890 to 930° C. When the heating temperature is less than 890° C., untransformed ferrite and pearlite remain, and when the heating temperature is more than 930° C., toughness deteriorates due to coarsening of crystal grains.

The heating holding time may be 70 to 110 minutes. When the heating holding time is less than 70 minutes, untransformed ferrite and pearlite remain, and when the heating holding time is more than 110 minutes, toughness deteriorates due to coarsening of crystal grains.

The salt bath temperature may be 270 to 290° C. When the salt bath temperature is less than 270° C., the hardening capability is excessive, so that brittleness is increased, and when the salt bath temperature is more than 290° C., the hardening capability is insufficient, so that untransformed austenite remains.

The salt bath holding time may be 50 to 70 minutes. When the salt bath holding time is less than 50 minutes, untransformed austenite remains, and when the salt bath holding time is more than 70 minutes, toughness deteriorates due to excessive precipitation of carbides.

Hereinafter, specific examples of the present invention will be described in detail. However, the Examples described below are only provided for specifically exemplifying or explaining the present invention, and the present invention is not limited thereby. Meanwhile, the cam pieces in the Example and the Comparative Examples of the present invention were prepared by gravity casting.

TABLE 1

| Classification | Carbon equivalent value | Spheroidal ratio (%) | Graphite size (μm) | Shrinkage defect size (mm) |
|---|---|---|---|---|
| Example 1 | 4.5 | 85 | 40 | 0.05 |
| Comparative Example 1 | 4.2 | 85 | 40 | 2.5 |
| Comparative Example 2 | 4.3 | 85 | 40 | 2.0 |
| Comparative Example 3 | 4.7 | 70 | 80 | 2.0 |
| Comparative Example 4 | 4.8 | 60 | 100 | 2.5 |

Table 1 is a table summarizing the spheroidal ratio, the graphite size, and the shrinkage defect size according to the carbon equivalent value. Under the operating conditions of a spheroidal ratio of 80% or more, a graphite size of 50 μm or less, and a shrinkage defect size of 0.1 mm or less (hereinafter, operating conditions 1), the cam piece of the present invention can be operated. Referring to Table 1, Example 1 in which a carbon equivalent value of 4.4 to 4.6 of the present invention is satisfied satisfies operating conditions 1, but the shrinkage defect sizes in Comparative Examples 1 and 2 in which the carbon equivalent value is less than 4.4 are more than 0.1 mm, and Comparative Examples 3 and 4 in which the carbon equivalent value is more than 4.6 exhibit a spheroidal ratio of less than 80%, a graphite size of more than 50 μm, and a shrinkage defect size of more than 0.1 mm.

TABLE 2

| Classification | Total content (wt %) of Ni + Cu + Mo | Microstructure | Carbides (%) | Tensile strength (MPa) | Elongation (%) |
|---|---|---|---|---|---|
| Example 2 | 2.0 | Bainite | 3 | 1300 | 2.5 |
| Comparative Example 5 | 1.7 | Bainite + Ferrite | 1 | 1000 | 4.0 |
| Comparative Example 6 | 1.8 | Bainite + Ferrite | 2 | 1100 | 3.5 |
| Comparative Example 7 | 2.2 | Bainite | 6 | 1500 | 0.5 |
| Comparative Example 8 | 2.3 | Bainite | 7 | 1600 | 0.1 |

Table 2 is a table summarizing the type of microstructure, the amount of carbides, the tensile strength, and the elongation according to the total content of nickel (Ni), copper (Cu), and molybdenum (Mo). Under the operating conditions of a bainite structure, 5% or less of carbides, a tensile strength of 1,200 MPa or more, and an elongation of 2% or more (Hereinafter, operating conditions 2), the cam piece of the present invention can be operated. The heating temperature, the heating time, the salt bath temperature, and the salt bath time are adjusted to 910° C., 90 minutes, 280° C., and 60 minutes, respectively.

Referring to Table 2, Example 2 in which the total content of nickel (Ni), copper (Cu), and molybdenum (Mo) of the present invention satisfies 1.9 to 2.1 wt % satisfies operating conditions 2 of the present invention, but in the case of Comparative Examples 5 and 6 in which the total content is less than 1.9 wt %, ferrite remains in the matrix structure and a tensile strength of less than 1,200 MPa is exhibited. In Comparative Examples 7 and 8 in which the total content is more than 2.1 wt %, more than 5% of carbides and an elongation of less than 2% are exhibited.

TABLE 3

| Classification | Content of Cu (wt %) | Microstructure | Carbides (%) | Tensile strength (MPa) | Elongation (%) |
|---|---|---|---|---|---|
| Example 3 | 0.75 | Bainite | 3 | 1300 | 2.5 |
| Comparative Example 9 | 0.3 | Bainite + Ferrite | 3 | 1000 | 4.0 |
| Comparative Example 10 | 0.4 | Bainite + Ferrite | 3 | 1100 | 3.5 |
| Comparative Example 11 | 1.1 | Bainite | 3 | 1400 | 0.7 |
| Comparative Example 12 | 1.2 | Bainite | 3 | 1500 | 0.5 |

Table 3 is a table summarizing the type of microstructure, the amount of carbides, the tensile strength, and the elongation according to the content of copper (Cu). Operating conditions 2 and heating and salt bath conditions of the present invention are described above. Referring to Table 3, in the case of Example 3 in which the content of copper (Cu) of the present invention satisfies 0.5 to 1.0 wt %, operating conditions 2 of the present invention are satisfied, but in the case of Comparative Examples 9 and 10 in which the content of copper (Cu) is less than 0.5 wt %, ferrite remains in the matrix structure, and a tensile strength of less than 1,200 MPa is exhibited. In the case of Comparative Examples 11 and 12 in which the content of copper (Cu) is more than 1.0 wt %, an elongation of less than 2% is exhibited.

TABLE 4

| Classification | Content of Mo (wt %) | Microstructure | Carbides (%) | Tensile strength (MPa) | Elongation (%) |
|---|---|---|---|---|---|
| Example 4 | 0.75 | Bainite | 3 | 1300 | 2.5 |
| Comparative Example 13 | 0.3 | Bainite + Ferrite | 1 | 1000 | 4.0 |
| Comparative Example 14 | 0.4 | Bainite + Ferrite | 2 | 1100 | 3.5 |
| Comparative Example 15 | 1.1 | Bainite | 6 | 1500 | 0.5 |

TABLE 4-continued

| Classification | Content of Mo (wt %) | Microstructure | Carbides (%) | Tensile strength (MPa) | Elongation (%) |
|---|---|---|---|---|---|
| Comparative Example 16 | 1.2 | Bainite | 7 | 1600 | 0.1 |

Table 4 is a table summarizing the type of microstructure, the amount of carbides, the tensile strength, and the elongation according to the content of molybdenum (Mo). Operating conditions 2 and heating and salt bath conditions of the present invention are described above. Referring to Table 4, in the case of Example 4 in which the content of molybdenum (Mo) of the present invention satisfies 0.5 to 1.0 wt %, operating conditions 2 of the present invention are satisfied, but in the case of Comparative Examples 13 and 14 in which the content of molybdenum (Mo) is less than 0.5 wt %, ferrite remains in the matrix structure, and a tensile strength of less than 1,200 MPa is exhibited. In the case of Comparative Examples 15 and 16 in which the content of molybdenum (Mo) is more than 1.0 wt %, more than 5% of carbides and an elongation of less than 2% are exhibited.

TABLE 5

| Classification | Content of Cr (wt %) | Microstructure | Carbides (%) | Tensile strength (MPa) | Elongation (%) |
|---|---|---|---|---|---|
| Example 5 | 0.2 | Bainite | 3 | 1300 | 2.5 |
| Comparative Example 17 | 0.4 | Bainite | 6 | 1500 | 0.5 |
| Comparative Example 18 | 0.5 | Bainite | 7 | 1600 | 0.1 |

Table 5 is a table summarizing the type of microstructure, the amount of carbides, the tensile strength, and the elongation according to the content of chromium (Cr). Operating conditions 2 and heating and salt bath conditions of the present invention are described above. Referring to Table 5, in the case of Example 5 in which the content of chromium (Cr) of the present invention satisfies 0.3 wt % or less, the operating conditions 2 of the present invention are satisfied, but in the case of Comparative Examples 17 and 18 in which the content of chromium (Cr) is more than 0.3 wt %, more than 5% of carbides and an elongation of less than 2% are exhibited.

TABLE 6

| Classification | Heating temperature (° C.) | Salt bath temperature (° C.) |
|---|---|---|
| Example 6 | 910 | 280 |
| Comparative Example 19 | 880 | 280 |
| Comparative Example 20 | 940 | 280 |
| Comparative Example 21 | 910 | 260 |
| Comparative Example 22 | 910 | 300 |

TABLE 7

| Classification | Microstructure | Carbides (%) | Tensile strength (MPa) | Elongation (%) |
|---|---|---|---|---|
| Example 6 | Bainite | 3 | 1300 | 2.5 |
| Comparative Example 19 | Bainite + Ferrite | 3 | 1100 | 3.5 |
| Comparative Example 20 | Bainite | 3 | 1100 | 0.5 |
| Comparative Example 21 | Bainite | 6 | 1500 | 0.5 |
| Comparative Example 22 | Bainite + Austenite | 3 | 1100 | 3.5 |

Table 6 is a table exhibiting the heating temperatures and salt bath temperatures in Example 6 and Comparative Examples 19 to 22, and Table 7 is a table summarizing the type of microstructure, the amount of carbides, the tensile strength, and the elongation in Example 6 and Comparative Examples 19 to 22. Operating conditions 2 of the present invention are described above. In the Example and the Comparative Examples, the contents of nickel (Ni), copper (Cu), and molybdenum (Mo) are 0.5 wt %, 0.75 wt %, and 0.75 wt %, respectively, the total content thereof is 2.0 wt %, and the content of chromium (Cr) is 0.2 wt %. The heating time and the salt bath time are 90 minutes and 60 minutes, respectively, which are the same as each other in the Example and the Comparative Examples.

Referring to Tables 6 and 7, it may be seen that in the case of Example 6 in which the heating temperature and salt bath temperature of the present invention satisfy 890 to 930° C. and 270 to 290° C., respectively, operating conditions 2 of the present invention are satisfied. However, in the case of Comparative Example 19 in which the heating temperature is less than 890° C., ferrite remains in the matrix structure and a tensile strength of less than 1,200 MPa is exhibited, and in the case of Comparative Example 20 in which the heating temperature is more than 930° C., a tensile strength of less than 1,200 MPa and an elongation of less than 2.0% are exhibited. Meanwhile, in the case of Comparative Example 21 in which the salt bath temperature is less than 270° C., more than 5% of carbides and an elongation of less than 2.0% are exhibited, and in the case of Comparative Example 22 in which the salt bath temperature is more than 290° C., austenite remains in the matrix structure and a tensile strength of less than 1,200 MPa is exhibited.

Table 8

| Classification | Heating holding time (min) | Salt bath holding time (min) |
|---|---|---|
| Example 7 | 90 | 60 |
| Comparative Example 23 | 60 | 60 |
| Comparative Example 24 | 120 | 60 |
| Comparative Example 25 | 90 | 40 |
| Comparative Example 26 | 90 | 80 |

TABLE 9

| Classification | Microstructure | Carbides (%) | Tensile strength (MPa) | Elongation (%) |
|---|---|---|---|---|
| Example 7 | Bainite | 3 | 1300 | 2.5 |
| Comparative Example 23 | Bainite + Ferrite | 3 | 1100 | 3.5 |
| Comparative Example 24 | Bainite | 3 | 1100 | 0.5 |
| Comparative Example 25 | Bainite + Austenite | 3 | 1100 | 3.5 |
| Comparative Example 26 | Bainite | 6 | 1500 | 0.5 |

Table 8 is a table exhibiting the heating times and salt bath times in Example 7 and Comparative Examples 23 to 26, and Table 8 is a table summarizing the type of microstructure, the amount of carbides, the tensile strength, and the elongation in Example 7 and Comparative Examples 23 to 26. Operating conditions 2 of the present invention are described above. In the Example and the Comparative Examples, the contents of nickel (Ni), copper (Cu), and molybdenum (Mo), the total content thereof, and the content of chromium (Cr) are described above, each heating temperature is 910° C., and each salt bath temperature is 280° C., which are the same as each other.

Referring to Tables 8 and 9, it may be seen that in the case of Examples 7 which satisfies a heating holding time of 70 to 110 minutes and a salt bath holding time of 50 to 70 minutes in an exemplary embodiment of the present invention, operating conditions 2 of the present invention are satisfied. However, in the case of Comparative Example 23 in which the heating holding time is less than 70 minutes, ferrite remains in the matrix structure and a tensile strength of less than 1,200 MPa is exhibited, and in the case of Comparative Example 24 in which the heating holding time is more than 110 minutes, a tensile strength of less than 1,200 MPa and an elongation of less than 2.0% are exhibited. Meanwhile, in the case of Comparative Example 25 in which the salt bath holding time is less than 50 minutes, austenite remains in the matrix structure and a tensile strength of less than 1,200 MPa is exhibited, and in the case of Comparative Example 26 in which the salt bath holding time is more than 70 minutes, more than 5% of carbides and an elongation of less than 2.0% are exhibited.

The present invention may implement a cam piece for a continuously variable valve apparatus, which has a complex shape by casting, and may satisfy mechanical properties required for the cam piece, more specifically, a tensile strength of 1,200 MPa or more, a yield strength of 900 MPa or more, an elongation of 2% or more, a surface hardness of HV 550 or more, and a core hardness of HV 450 or more by optimizing the composition and process conditions of the alloy. Furthermore, it is possible to form a microstructure for implementing these mechanical properties, more specifically, a spheroidal ratio of 80% or more, a graphite size of 50 μm or less, a bainite matrix structure, 5% or less of carbides, and a shrinkage defect size of 1.0 mm or less. Furthermore, according to an exemplary embodiment of the present invention, there is an advantage in that it is also possible to apply the present invention to portions having a function similar to that of the cam piece for a continuously variable valve apparatus.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the FIGURES. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method of manufacturing a cam piece for a continuously variable valve duration, the method comprising:

manufacturing the cam piece by casting;

heating the cam piece;

maintaining a heating temperature; and salt-bathing the cam piece, wherein the cam piece comprises 3.2 to 4.2 wt % of carbon (C), 2.2 to 3.4 wt % of silicon (Si), and balance iron (Fe), and has a carbon equivalent value according to a formula 1 of 4.4 to 4.6, wherein formula 1 is =wt % C+(1/3) wt % Si, wherein the cam piece further comprises nickel (Ni), copper (Cu) and molybdenum (Mo) and a total content of nickel (Ni), copper (Cu) and molybdenum (Mo) is 1.9 to 2.1 wt %, wherein a content of nickel (Ni) is greater than 0 and 1.0 wt % or less, wherein a content of copper (Cu) is 0.5 to 1.0 wt %, and wherein a content of molybdenum (Mo) is 0.5 to 1.0 wt %, wherein in the maintaining of the heating temperature, the heating temperature is 890 to 930° C., and a heating holding time is 70 to 110 minutes, wherein in the salt-bathing of the cam piece, a salt bath temperature is 270 to 290° C., and a salt bath holding time is 50 to 70 minutes, a microstructure of the cam piece is bainite, an amount of carbide is 5% or less, a tensile strength of the cam piece is 1,200 MPa or more, and an elongation of the cam piece is 2% or more.

2. The method of claim 1, wherein the cam piece further comprises 0.3 wt % or less of chromium (Cr).

* * * * *